US012420381B2

(12) United States Patent
Shi et al.

(10) Patent No.: US 12,420,381 B2
(45) Date of Patent: Sep. 23, 2025

(54) ABRASIVE ARTICLE AND METHOD OF FORMING

(71) Applicants: SAINT-GOBAIN ABRASIVES, INC., Worcester, MA (US); SAINT-GOBAIN ABRASIFS, Conflans-Sainte-Honorine (FR)

(72) Inventors: Zehua Shi, Shanghai (CN); Xiaochao Song, Shanghai (CN); Gufen Qian, Shanghai (CN)

(73) Assignees: SAINT-GOBAIN ABRASIVES, INC., Worcester, MA (US); SAINT-GOBAIN SURFACE SOLUTIONS FRANCE, Conflans-Sainte-Honorine (FR)

( * ) Notice: Subject to any disclaimer, the term of this patent is extended or adjusted under 35 U.S.C. 154(b) by 768 days.

(21) Appl. No.: 17/453,563

(22) Filed: Nov. 4, 2021

(65) Prior Publication Data

US 2022/0134510 A1 May 5, 2022

(30) Foreign Application Priority Data

Nov. 4, 2020 (CN) ..... 202011215956.5

(51) Int. Cl.
*B24D 3/34* (2006.01)
*B24D 3/22* (2006.01)

(52) U.S. Cl.
CPC ..... *B24D 3/344* (2013.01); *B24D 3/22* (2013.01)

(58) Field of Classification Search
CPC ..... B24D 3/344; B24D 3/22
See application file for complete search history.

(56) References Cited

U.S. PATENT DOCUMENTS 6,331,580 B1 12/2001 Molnar
6,337,131 B1 * 1/2002 Rupaner ..... C08F 291/00 428/407
7,438,636 B2 * 10/2008 Kulp ..... B24B 37/24 51/307
8,378,013 B2 2/2013 Pirri et al.
9,539,701 B2 1/2017 Sarangi et al.
(Continued)

FOREIGN PATENT DOCUMENTS

CN 101421344 A 4/2009
CN 106232712 A 12/2016
(Continued)

OTHER PUBLICATIONS

Chen, X.D., Wang, J.S. & Shen, J.R. J Polym Res (2006) 13: 335. https://doi.org/10.1007/s10965-006-9048-8 (Abstract only).
(Continued)

*Primary Examiner* — Alexandra M Moore
(74) *Attorney, Agent, or Firm* — Abel Schillinger, LLP; Arpan Ghosh

(57) ABSTRACT

An abrasive article can include a body including a bond material, abrasive particles contained in the bond material, and an impact modifier. In an embodiment, the impact modifier can be in a content of at least 1 vol % of and at most 10 vol % for a total volume of the body. In another embodiment, the impact modifier can include particles having an average particle size ($D_{50}$) of at least 10 microns, a particle size $D_{10}$ of at least 2 microns, a particles size $D_{90}$ of at most 2 mm or any combination thereof.

19 Claims, 4 Drawing Sheets

(56) References Cited

U.S. PATENT DOCUMENTS

| | | | | |
|---|---|---|---|---|
| 10,316,127 | B2 | 6/2019 | Navarro et al. | |
| 2005/0263171 | A1 | 12/2005 | Wu et al. | |
| 2010/0144971 | A1 | 6/2010 | Babcock et al. | |
| 2017/0355802 | A1* | 12/2017 | Navarro | C08F 279/02 |
| 2020/0071514 | A1 | 3/2020 | Shafer et al. | |

FOREIGN PATENT DOCUMENTS

| | | | |
|---|---|---|---|
| EP | 1514883 | A1 | 3/2005 |
| JP | 2003011066 | A | 1/2003 |
| JP | 2007528301 | A | 10/2007 |
| KR | 20000022759 | A | 4/2000 |
| KR | 20080058270 | A | 6/2008 |
| KR | 20170087922 | A | 7/2017 |
| WO | 2022099285 | A1 | 5/2022 |

OTHER PUBLICATIONS

International Search Report and Written Opinion for PCT/US2021/072240, mailed Feb. 28, 2022, 9 pages.

* cited by examiner

ABRASIVE ARTICLE AND METHOD OF FORMING

CROSS-REFERENCE TO RELATED APPLICATION(S)

This application claims priority to Chinese Application No. 202011215956.5, entitled "ABRASIVE ARTICLE AND METHOD OF FORMING," by Zehua SHI et al., filed Nov. 4, 2020, which is assigned to the current assignee hereof and incorporated herein by reference in its entirety.

FIELD OF THE DISCLOSURE

The following is directed to abrasive articles and methods of forming the same, and in particular, to abrasive articles including an impact modifier and methods of forming the same.

DESCRIPTION OF THE RELATED ART

Abrasive articles are used in material removal operations, such as cutting, grinding, or shaping various materials. Fixed abrasive articles include abrasive particles held in a bond material. The bond material can include an organic and/or inorganic material. The industry continues to demand improved abrasive articles.

BRIEF DESCRIPTION OF THE DRAWINGS

The present disclosure may be better understood, and its numerous features and advantages made apparent to those skilled in the art by referencing the accompanying drawings.

Figure 1:
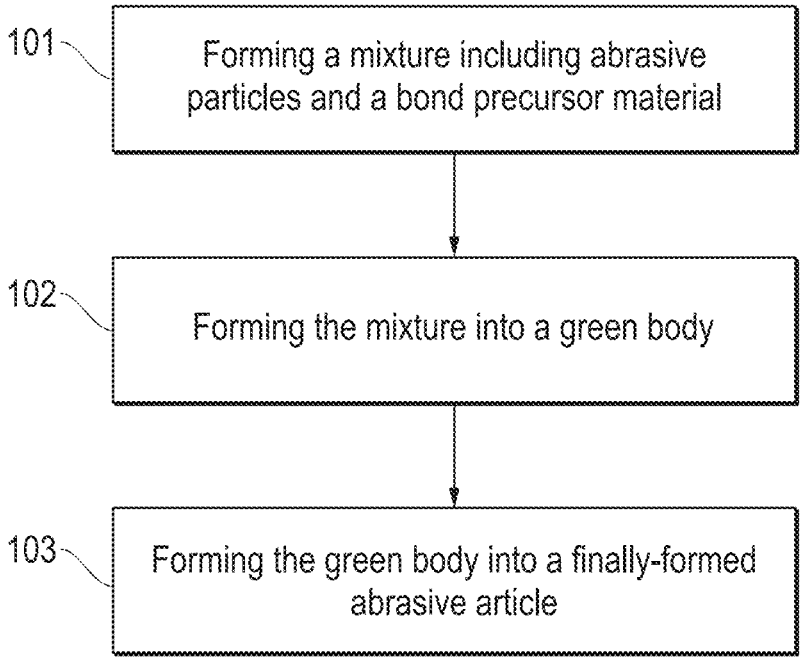
FIG. 1 includes a flowchart illustrating a forming process of an abrasive article according to an embodiment.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings provided herein. The following disclosure will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

Embodiments are directed to an abrasive article including a body including an impact modifier. The abrasive article can have improved properties and/or performance. For example, the abrasive article can have improved flexibility and impact strength. In another example, improved property can include improved Yang's modulus and desirable maximum flexure stress. In this disclosure, Yang's modulus and maximum flexure stress is determined by the 3-point bending test performed on Instron® universal testing machine using the parameters as follows. The test speed is 1.27 mm/min, support span is 50.8 mm, and the load cell is 10 kN. The test can be performed on a bar sample representative of an abrasive article. The bar sample can have the dimension of 10×1×0.5 inches. At least three samples are tested to obtain the Yang's modulus and maximum flexure stress of the abrasive article. In this disclosure, Yang's modulus is also referred to as modulus of elasticity (EMOD), and the maximum flexure stress is also referred to as Modulus of Rupture (MOR). In further examples, the abrasive article can have an improved ratio of MOR to EMOD, which can facilitate improved surface finishing of a workpiece and grinding operation.

In an embodiment, the abrasive article can include a fixed abrasive article, such as bonded abrasives and coated abrasive. The bonded abrasive bodies may be distinct from other abrasive articles in that the body is essentially free of a substrate. A particular example of the abrasive article can include grinding wheels, cutoff wheels, ultra-thin wheels, combination wheels, cutting wheels, chop saws, or any combination thereof. Another example can include a belt, a disc, or the like, or any combination thereof.

FIG. 1 includes a flowchart illustrating a process of forming an abrasive article in accordance with an embodiment. As illustrated, at step 101, the process can be initiated by forming a mixture including the components or precursor components to be part of the finally-formed abrasive article body. In an embodiment, the mixture can include an impact modifier. The impact modifier can help modify modulus of the abrasive article. In an aspect, the impact modifier can include a modulus, such as Yang's modulus, less than the modulus of the bond material or bond precursor material. In a particular example, the modulus of the impact modifier can be at least one order of magnitude less than the bond material or bond precursor material. For example, the impact modifier can include a modulus that is at least one order of magnitude less than phenolic resin. In an aspect, the impact modifier can be in the form of a powder including particles. The impact modifier particles can be mixed with the other components or precursor components, including abrasive particles and a bond material or bond precursor material, and optionally, fillers, additives, reinforcing materials, and the like.

In another aspect, the mixture can include a particular content of the impact modifier that can facilitate improved property and/or performance of the abrasive article. For example, the mixture can include at least 0.05 wt % of the impact modifier for a total weight of the mixture, such as at least 0.06 wt %, at least 0.07 wt %, at least 0.08 wt %, at least 0.09 wt %, at least 0.1 wt %, at least 0.12 wt %, at least 0.13 wt %, at least 0.15 wt %, at least 0.17 wt %, at least 0.18 wt %, at least 0.19 wt %, at least 0.2 wt %, at least 0.21 wt %, at least 0.22 wt %, or at least 0.23 wt % for the total weight of the mixture. In another example, the mixture can include at most 10 wt % of the impact modifier for a total weight of the mixture, such as at most 8 wt %, at most 7 wt %, at most 6 wt %, at most 5 wt %, at most 3 wt %, at most 2 wt %, at most 1 wt %, at most 0.9 wt %, at most 0.8 wt %, at most 0.7 wt %, at most 0.6 wt %, at most 0.5 wt %, at most 0.4 wt %, at most 0.3 wt %, at most 0.28 wt %, at most 0.26%, at most 0.25 wt %, at most 0.24 wt %, or at most 0.23 wt % for a total weight of the mixture. In a particular example, the mixture can include the impact modifier in a content including any of the minimum and maximum percentages noted herein. For example, the impact modifier can be in a range including at least 0.05 wt % to at most 10 wt % or in a range including at least 0.1 wt % to at most 5 wt % or in a range including at least 0.16 wt % to at most 3 wt % or in a range including at least 0.05 wt % to at most 1 wt % or in a range including at least 0.08 wt % to at most 0.8 wt % or in a range including at least 0.1 wt % to at most 0.5 wt % or in a range including 0.1 wt % to at most 0.3 wt % for the total weight of the mixture.

In an embodiment, the impact modifier can include a particular particle size distribution including, $D_{10}$, $D_{50}$, $D_{90}$, or any combination thereof of the particles. $D_{10}$, $D_{50}$, $D_{90}$ can be determined by measuring at least 10000 particles in a dry dispersion of the impact modifier using Mastersizer 2000 laser diffraction particle size analyzer from Malvern Panalytical. In an aspect, the impact modifier can include particles having a particular average particle size, $D_{50}$, that can facilitate improved property and performance of the abrasive article. For example, the impact modifier can include an average particle size of at least 10 microns, at least 40 microns, at least 60 microns, at least 90 microns, at least 100 microns, at least 120 microns, at least 140 microns, at least 160 microns, at least 180 microns, at least 200 microns, at least 220 microns, at least 235 microns, at least 270 microns, at least 295 microns, at least 340 microns, at least 385 microns, or at least 420 microns. In another example, the impact modifier can include an average particle size of at most 900 microns, at most 800 microns, at most 700 microns, at most 600 microns, at most 500 microns, at most 450 microns, at most 400 microns, at most 350 microns, or at most 300 microns. In a particular example, the impact modifier can include an average particle size of the particles in a range including any of the minimum and maximum values noted herein, such as in a range including at least 10 microns and at most 900 microns or in a range including at least 120 microns and at most 600 microns.

In an aspect, the impact modifier can include particles having a particular $D_{10}$ that can facilitate improved property and performance of the abrasive article. $D_{10}$ is intended to define the maximum particle size of the particles in the lowest 10% of the distribution (i.e., the particle size of the impact modifier particles in the $10^{th}$ percentile of the distribution). For example, the impact modifier can include a $D_{10}$ of at least 2 microns, at least 4 microns, at least 5 microns, at least 8 microns, at least 10 microns, at least 15 microns, at least 20 microns, at least 25 microns, at least 30 microns, at least 35 microns, at least 40 microns, at least 45 microns, at least 50 microns, at least 55 microns, at least 60 microns, at least 65 microns, at least 70 microns, at least 75 microns, at least 80 microns, at least 85 microns, at least 90 microns, at least 95 microns, or at least 100 microns, at least 120 microns, at least 140 microns, at least 155 microns, or at least 170 microns. In another example, the impact modifier can include a $D_{10}$ of at most 280 microns, at most 250 microns, at most 210 microns, at most 180 microns, at most 160 microns, at most 150 microns, at most 140 microns, at most 130 microns, at most 120 microns, or at most 110 microns. In a particular example, the impact modifier can include $D_{10}$ of the particles in a range including any of the minimum and maximum values noted herein.

In an aspect, the impact modifier can include particles having a particular $D_{90}$ that can facilitate improved property and performance of the abrasive article. $D_{90}$ is intended to define the minimum particle size of the particles in the greatest 10% of the distribution (i.e., the particle size for the impact modifier particles in the $90^{th}$ percentile of the distribution). For example, the impact modifier can include a $D_{90}$ of at least 210 microns, at least 230 microns, at least 250 microns, at least 270 microns, at least 290 microns, at least 300 microns, at least 320 microns, at least 330 microns, at least 340 microns, at least 350 microns, at least 360 microns, at least 370 microns, at least 380 microns, at least 410 microns, at least 450 microns, at least 475 microns, at least 495 microns, at least 520 microns, at least 560 microns, at least 585 microns, or at least 620 microns. In another example, the impact modifier can include a $D_{90}$ of at most 2000 microns, at most 1500 microns, at most 1200 microns, at most 1000 microns, at most 950 microns, at most 900 microns, at most 850 microns, at most 800 microns, at most 750 microns, at most 720 microns at most 700 microns, at most 680 microns, at most 670 microns, at most 660 microns, at most 650 microns, at most 620 microns, at most 600 microns, at most 580 microns, at most 550 microns, at most 520 microns, at most 500 microns, at most 480 microns, at most 460 microns, at most 450 microns, at most 430 microns, at most 410 microns, or at most 400 microns. In a particular example, the impact modifier can include $D_{90}$ of the particles in a range including any of the minimum and maximum values noted herein.

In an embodiment, the impact modifier can include a high performance impact modifier. In an aspect, the impact modifier can improve elasticity of the bond material and help maintain rigidity of the bond material. For example, the impact modifier can improve EMOD of the abrasive article and facilitate improved ratio of MOR to EMOD over an abrasive article having similar EMOD without the impact modifier. In another instance, the impact modifier may have improved performance over rubber particles. In a further instance, the abrasive article including the impact modifier can have improved EMOD and ratio of MOR to EMOD compared to similar abrasive article having a rubber-modified bond material without the impact modifier.

In a particular embodiment, the impact modifier can include particles including a core-shell structure. In an aspect, the core and the shell can include a different modulus. For example, the core can include a higher flexibility, such as relatively high EMOD, than the shell. In another example, the shell may include a higher rigidity or stiffness, such as flexure modulus, than the core. In another example, the core can have a particular EMOD, flexure modulus, or a combination thereof, that can facilitate improved performance and/or property of the abrasive article. In a further example, the shell can have particular elastic modulus, flexure modulus, or a combination thereof, that can facilitate improved performance and/or property of the abrasive article.

In an embodiment, the particle size distribution of impact modifier in a finally formed abrasive article may be determined using Raman mapping as follows. A cross-sectional sample of a finally-formed abrasive body may be mapped by using confocal Raman microscopy. For example, a confocal microscope Raman spectrometer from Renishaw (i.e., Renishaw Centrus 0RNQ39) or an equivalent device can be used. The samples can have a size of 3 microns to 200 microns and be mounted on a fixture using epoxy resin at ambient temperature (20 to 25° C.). The surface of the sample can be ground and polished such that the cross section can be clear for scanning. The spectra can be recorded on a Renishaw Centrus 0RNQ39 monochromator with the laser set at 785 nm edge and grating 1200 I/mm (633/780) and ×50 L objective lens. Using MBS impact modifier as an example, Raman mapping can be performed using the area between 1700 and 1654 $cm^{-1}$ for the impact modifier. For the bond material including phenolic resin, the Raman mapping area can be between 747 and 803 $cm^{-1}$. $D_{50}$, $D_{10}$, and $D_{90}$ of impact modifier can be determined by measuring at least 100 randomly selected impact modifier particles. In instances, the impact modifier include agglomerated particles, at least 100 randomly selected agglomerates can be measured for determining $D_{50}$, $D_{10}$, and $D_{90}$ of the agglomerates. A skilled artisan will appreciate the area can be selected according to the chemical compositions (i.e., chemical groups) of the core, the shell, or both of the impact modifier and the bond material. The area selected for the impact modifier should be different from the area selected for the bond material.

In a further embodiment, the core-shell structure of impact modifier in the finally-formed abrasive body may be detected using Atomic Force Microscopy. For example, Nanonavi E-Sweep from Alfa Chemistry or an equivalent device can be used. Due to differences in moduli, i.e., Yang's modulus, of the core material (e.g., butadiene rubber) and shell material (e.g., polystyrene-methyl methacrylate polymer), the core-shell structure can be detected by Atomic Force Microscopy. The abrasive body can be cut into thin slices, i.e., having the thickness of 5 microns to not greater than 100 microns. Care should be taken for preparing the slices, so that at least some of the slices can include intact cross sections of particles of the impact modifier, in which cores are exposed. In an example, FIB (focused ion beam) may be suitably used to prepare the slices. At least 5 different images of the slices including exposed cores should be examined to determine the core-shell structure of particles of the impact modifier. A skilled artisan will appreciate the number of the images can be increased to allow a statistically significant number of impact modifier particles having the core-shell structure to be identified.

In an embodiment, the impact modifier may include a particular average core volume that can facilitate improved performance of the abrasive article. In an aspect, the core can have an average volume that can constitute greater than 50% of the average particle volume of the impact modifier particles, such as at least 60%, at least 70%, at least 80%, at least 85%, or at least 90% of the average particle volume of the impact modifier. In another aspect, the core can have an average volume that can constitute at most 95% of the average particle volume of the impact modifier, such as at most 90%, at most 88%, at most 85%, at most 82%, at most 80%, at most 76%, at most 73%, or at most 70% of the average particle volume of the impact modifier. Moreover, the impact modifier particles may include an average volume of the core in a range including any of the minimum and maximum percentages noted herein. Volumes of the impact modifier particles, cores, and shells can be determined based on images obtained by Atomic Force Microscopy as described in embodiments herein. At least 100 impact modifier particles and cores and shells of the particles can be measured to determine the respective average volumes.

In an embodiment, the impact modifier particles may include particular average shell volume that can facilitate improved performance of the abrasive article. In an aspect, the shell can have an average volume that can constitute less than 50% of the average particle volume of the impact modifier, such as at most 40%, at most 36%, at most 31%, at most 27%, at most 24%, at most 20%, at most 16%, at most 13%, at most 10%, or at most 8% of the average particle volume of the impact modifier. In another aspect, the shell can have an average volume that can constitute at least 2% of the average particle volume of the impact modifier, such as at least 4%, at least 7%, at least 10%, at least 13%, at least 16%, at least 19%, at least 20%, at least 23%, at least 26%, at least 30%, or at least 32% of the average particle volume of the impact modifier. Moreover, the impact modifier particles may include an average shell volume in a range including any of the minimum and maximum percentages noted herein.

A skilled artisan can appreciate the particle size of a particle of the impact modifier can be made up by the core diameter and shell thickness.

In an embodiment, the core can include an organic material. For example, the core can include a polymer including a rubber type polymer, such as butadiene rubber, butadiene styrene rubber, butadiene-acrylonitrile rubber, or the like, or any combination thereof. In another aspect, the shell can include an organic material. For example, the shell can include a polymer including acrylic polymers, styrene polymers, or any combination thereof. In another aspect, the impact modifier can include particles including chemical bond between the core and shell. In another particular aspect, the impact modifier can include a block polymer. In a more particular aspect, the impact modifier can include a polymer including at least 3 blocks. In particular aspects, the impact modifier can include particles including a polymer including methyl methacrylate-butadiene-styrene polymer, acrylic-butadiene-styrene polymer, or any combination thereof.

Figure 4A:
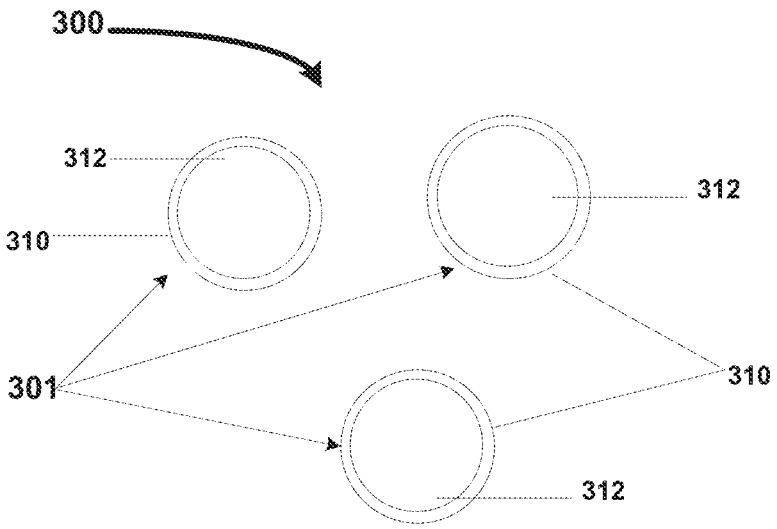
FIG. 4A and FIG. 4B include illustrations of impact modifier according to embodiments herein.

In a further embodiment, the impact modifier can include unagglomerated particles, agglomerated particles, or a combination thereof. Referring to FIG. 4A, exemplary impact modifier 300 is illustrated including a plurality of unagglomerated particles 301. Each particle 301 can include a core 312 and a shell 310.

Figure 4B:
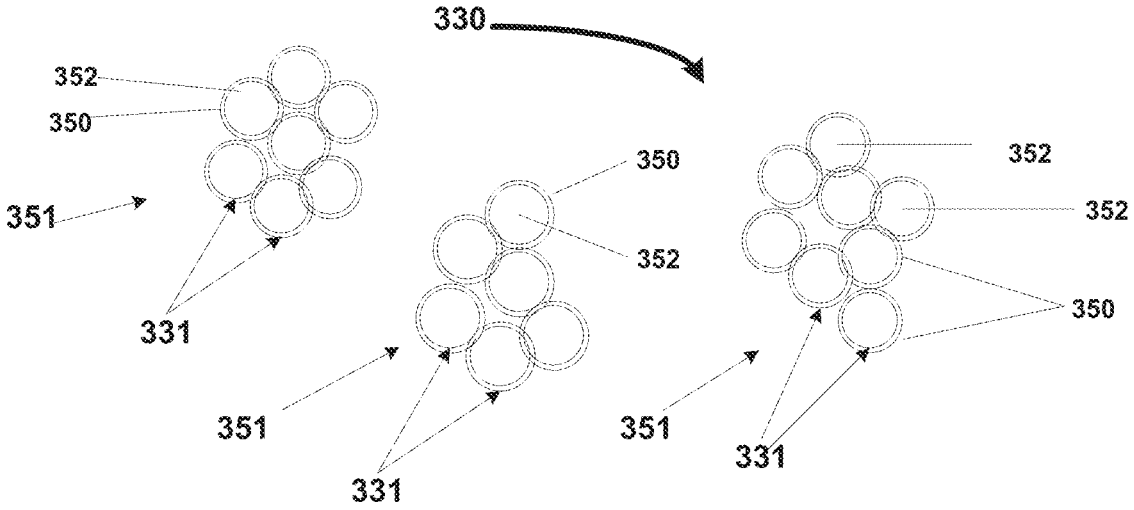

In a particular embodiment, the impact modifier can include agglomerated particles, in which each agglomerate can include a plurality of particles. In an aspect, each agglomerate can include particles having a core-shell structure. Referring to FIG. 4B, impact modifier 330 can include a plurality of agglomerates 351, and each agglomerate 351 can include a plurality of particles 331. Each particle 331 can include a core 352 and a shell 350.

In another aspect, the impact modifier can include at least 50 vol % of agglomerated particles relative to the total volume of the impact modifier particles, such as at least 60 vol %, at least 70 vol %, at least 80 vol %, at least 90 vol %, at least 95%, or at least 99 vol % of agglomerated particle for the total volume of the impact modifier particles. In another aspect, the impact modifier can include at most 95 vol % of agglomerated particles for a total volume of the impact modifier particles, such as at most 90 vol %, at most 80 vol %, at most 70 vol %, at most 60 vol %, at most 50 vol %, at most 40 vol %, at most 30 vol %, at most 20 vol %, at most 10 vol %, or at most 5 vol % of agglomerated particles for the total volume of the impact modifier particles. In a further example, the impact modifier can include agglomerated particles in a range including any of the minimum and maximum percentages noted herein.

In a more particular aspect, the impact modifier can consist of agglomerated particles. It is to be appreciated the agglomerates (e.g., agglomerates 351 illustrated in FIG. 3B) can have the particle size distribution including any or any combination of $D_{10}$, $D_{50}$, and $D_{90}$, as noted in embodiments in relation to impact modifier herein.

In a further aspect, particles contained in the agglomerated impact modifier particles can be held by Van der Waals forces, chemical bonds, or any combination thereof. In another aspect, agglomerated impact modifier particles can include an average particle size of particles contained in agglomerated impact modifier particles. In an example, particles contained in the agglomerated impact modifier particles can have an average particle size of at least 1 nm, such as at least 2 nm, at least 5 nm, at least 10 nm, at least 15 nm, at least 20 nm, at least 25 nm, at least 30 nm, at least 35 nm, at least 40 nm, at least 50 nm, at least 60 nm, at least 70 nm, at least 80 nm, at least 90 nm, at least 100 nm, at least 200 nm, at least 300 nm, at least 400 nm, at least 500 nm, at least 600 nm, at least 700 nm, at least 800 nm, at least 900 nm, at least 1 micron, at least 2 microns, at least 5 microns, at least 10 microns, or at least 20 microns. In another aspect, particles contained in the agglomerated particles an include an average particle size of at most 100 microns, at most 90 microns, at most 80 microns, at most 70 microns, at most 60 microns, at most 50 microns, at most 40 microns, at most 30 microns, at most 20 microns, at most 10 microns, at most 9 microns, at most 8 microns, at most 7 microns, at most 6 microns, at most 4 microns, at most 3 microns, at most 1 micron, at most 800 nm, at most 700 nm, at most 600 nm, at most 500 nm, at most 400 nm, at most 300 nm, at most 200 nm, or at most 100 nm. In a particular aspect, particles contained in the agglomerated particle can have an average particle size in a range including any of the minimum and maximum values noted herein.

In a further aspect, at least 50 vol % of the particles contained in the agglomerated particles can have a particle size in a range from 1 nm to 2 microns, at least 60 vol %, at least 70 vol %, at least 80 vol %, or at least 90 vol % of the particles contained in the agglomerated particles have the particle size in the range from 1 nm to 2 microns. In a further aspect, essentially all of the particles contained in the agglomerated particles can have a particle size in a range from 1 nm to 2 microns.

In another aspect, the impact modifier can include unagglomerated particles. For example, the impact modifier can include at least 1 vol % of unagglomerated particles relative to the total volume of the impact modifier particles, such as at least 2 vol %, at least 5 vol %, at least 10 vol %, at least 20 vol %, at least 30 vol %, at least 50 vol % at least 60 vol %, at least 70 vol %, at least 80 vol %, at least 90 vol %, at least 95%, or at least 99 vol % of unagglomerated particle for the total volume of the impact modifier particles. In a particular example, the impact modifier can consist of unagglomerated particles. In another example, the impact modifier can include at most 90 vol % of unagglomerated particles for a total volume of the impact modifier particles, such as at most 80 vol %, at most 70 vol %, at most 60 vol %, at most 50 vol %, at most 40 vol %, at most 30 vol %, at most 20 vol %, at most 10 vol %, or at most 5 vol % of unagglomerated particles for the total volume of the impact modifier particles. In a further example, the impact modifier can include unagglomerated particles in a range including any of the minimum and maximum percentages noted herein. It is to be appreciated the unagglomerated impact modifier particles can have the particle size including any or any combination of $D_{10}$, $D_{50}$, and $D_{90}$, as noted in embodiments herein.

In an embodiment, the mixture can include abrasive particles. In an aspect, the abrasive particles can include unagglomerated particles, agglomerates, aggregates, or any combination thereof. In another aspect, the abrasive particles can include microcrystalline materials, nanocrystalline materials, vitreous material, amorphous material, or any combination thereof. In a particular aspect, the abrasive particles can include a material including oxides, carbides, nitrides, borides, carbon-based materials (e.g., diamond), oxycarbides, oxynitrides, oxyborides, superabrasive material, or a combination thereof. In a particular example, the abrasive particles can include a material selected from the group of silicon dioxide, silicon carbide, alumina, zirconia, flint, garnet, emery, rare earth oxides, rare earth-containing materials, cerium oxide, sol-gel derived particles, gypsum, iron oxide, glass-containing particles, and a combination thereof. In another instance, abrasive particles may also include silicon carbide (e.g., Green 39C and Black 37C), brown fused alumina (57A), seeded gel abrasive, sintered alumina with additives, shaped and sintered aluminum oxide, pink alumina, ruby alumina (e.g., 25A and 86A), electrofused monocrystalline alumina 32A, MA88, alumina zirconia abrasives (e.g., NZ, NV, ZF Brand from Saint-Gobain Corporation), extruded bauxite, sintered bauxite, cubic boron nitride, diamond, aluminum oxy-nitride, sintered alumina (e.g., Treibacher's CCCSK), extruded alumina (e.g., SR1, TG, and TGII available from Saint-Gobain Corporation), or any combination thereof. In a particular implementation, the abrasive particles can consist essentially of silicon carbide, alumina, or any combination thereof. In a further aspect, the abrasive particles can have a Mohs hardness or at least 7, such as at least 8, or even at least 9.

The abrasive particles may have other particular features. For example, the abrasive particles may have an elongated shape. In particular instances, the abrasive particles may have an aspect ratio, defined as a ratio of the length:width of at least about 1:1, wherein the length is the longest dimension of the particle and the width is the second longest dimension of the particle (or diameter) perpendicular to the dimension of the length. In other embodiments, the aspect ratio of the abrasive particles can be at least about 2:1, such as at least about 2.5:1, at least about 3:1, at least about 4:1, at least about 5:1, or even at least about 10:1. In one non-limiting embodiment, the abrasive particles may have an aspect ratio of not greater than about 5000:1.

According to at least one embodiment, at least a portion of the abrasive particles may include shaped abrasive particles as disclosed for example, in US 20150291865, US 20150291866, and US 20150291867. Shaped abrasive particles are formed such that each particle has substantially the same arrangement of surfaces and edges relative to each other for shaped abrasive particles having the same two-dimensional and three-dimensional shapes. As such, shaped abrasive particles can have a high shape fidelity and consistency in the arrangement of the surfaces and edges relative to other shaped abrasive particles of the group having the same two-dimensional and three-dimensional shape. By contrast, non-shaped abrasive particles can be formed through different process and have different shape attributes. For example, non-shaped abrasive particles are typically formed by a comminution process, wherein a mass of material is formed and then crushed and sieved to obtain abrasive particles of a certain size. However, a non-shaped abrasive particle will have a generally random arrangement of the surfaces and edges, and generally will lack any recognizable two-dimensional or three dimensional shape in the arrangement of the surfaces and edges around the body. Moreover, non-shaped abrasive particles of the same group or batch generally lack a consistent shape with respect to each other, such that the surfaces and edges are randomly arranged when compared to each other. Therefore, non-shaped grains or crushed grains have a significantly lower shape fidelity compared to shaped abrasive particles.

In one embodiment, the abrasive particles can include shaped abrasive particles including a two dimensional shape selected from the group consisting of regular polygons, irregular polygons, irregular shapes, triangles, partially-concave triangles, quadrilaterals, rectangles, trapezoids, pentagons, hexagons, heptagons, octagons, ellipses, Greek alphabet characters, Latin alphabet characters, Russian alphabet characters, a triangular two-dimensional shape, a partially-concave triangular two-dimensional shape, and a combination thereof.

In another embodiment, the abrasive particles can include shaped abrasive particles including a three-dimensional shape selected from the group consisting of a polyhedron, a pyramid, an ellipsoid, a sphere, a prism, a cylinder, a cone, a tetrahedron, a cube, a cuboid, a rhombohedron, a truncated pyramid, a truncated ellipsoid, a truncated sphere, a truncated cone, a pentahedron, a hexahedron, a heptahedron, an octahedron, a nonahedron, a decahedron, a Greek alphabet letter, a Latin alphabet character, a Russian alphabet character, a Kanji character, complex polygonal shapes, irregular shaped contours, a volcano shape, a monostatic shape, and a combination thereof. As used herein, a monostatic shape is a shape with a single stable resting position.

In a further embodiment, the abrasive particles can include shaped abrasive particles including a body having a body length (Lb), a body width (Wb), and a body thickness (Tb), and wherein Lb>Wb, Lb>Tb, and Wb>Tb. In an aspect, the body can include a primary aspect ratio (Lb:Wb) of at least about 1:1 or at least about 2:1 or at least about 3:1 or at least about 5:1 or at least about 10:1, and not greater than about 1000:1. In another aspect, the body can include a secondary aspect ratio (Lb:Tb) of at least about 1:1 or at least about 2:1 or at least about 3:1 or at least about 5:1 or at least about 10:1, and not greater than about 1000:1. In a further aspect, the body can include a tertiary aspect ratio (Wb:Tb) of at least about 1:1 or at least about 2:1 or at least about 3:1 or at least about 5:1 or at least about 10:1, and not greater than about 1000:1. In another aspect, at least one of the body length (Lb), the body width (Wb), and the body thickness (Tb) can have an average dimension of at least about 0.1 microns or at least about 1 micron or at least about 10 microns or at least about 50 microns or at least about 100 microns or at least about 150 microns or at least about 200 microns or at least about 400 microns or at least about 600 microns or at least about 800 microns or at least about 1 mm, and not greater than about 20 mm or not greater than about 18 mm or not greater than about 16 mm or not greater than about 14 mm or not greater than about 12 mm or not greater than about 10 mm or not greater than about 8 mm or not greater than about 6 mm or not greater than about 4 mm.

In a further embodiment, the mixture and the resulting abrasive article can include a blend of abrasive particles. The blend of abrasive particles can include a first type of abrasive particle and a second type of abrasive particle, which is distinct from the first type of abrasive particle in at least one aspect, such as particle size, grain size, composition, shape, hardness, friability, toughness, and the like. For example, in one embodiment, the first type of abrasive particle can include a premium abrasive particle (e.g., fused alumina, alumina-zirconia, seeded sol gel alumina, shaped abrasive particle, etc.) and the second type of abrasive particle can include a diluent abrasive particle.

The blend of abrasive particles can include a first type of abrasive particle present in a first content (C1), which may be expressed as a percentage (e.g., a weight percent) of the first type of abrasive particles as compared to the total content of particles of the blend. Furthermore, the blend of abrasive particles may include a second content (C2) of the second type of abrasive particles, expressed as a percentage (e.g., a weight percent) of the second type of abrasive particles relative to the total weight of the blend. The first content can be the same as or different from the second content. For example, in certain instances, the blend can be formed such that the first content (C1) can be not greater than 90% of the total content of the blend. In another embodiment, the first content may be less, such as not greater than 85%, not greater than 80%, not greater than 75%, not greater than 70%, not greater than 65%, not greater than 60%, not greater than 55%, not greater than 50%, not greater than 45%, not greater than 40%, not greater than 35%, not greater than 30%, not greater than 25%, not greater than 20%, not greater than 15%, not greater than 10%, or even not greater than 5%. Still, in one non-limiting embodiment, the first content of the first type of abrasive particles may be present in at least 1% of the total content of abrasive particles of the blend. In yet other instances, the first content (C1) may be at least 5%, such as at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or even at least 95%. It will be appreciated that the first content (C1) may be present within a range between any of the minimum and maximum percentages noted above.

The blend of abrasive particles may include a particular content of the second type of abrasive particle. For example, the second content (C2) may be not greater than 98% of the total content of the blend. In other embodiments, the second content may be not greater than 95%, such as not greater than 90%, not greater than 85%, not greater than 80%, not greater than 75%, not greater than 70%, not greater than 65%, not greater than 60%, not greater than 55%, not greater than 50%, not greater than 45%, not greater than 40%, not greater than 35%, not greater than 30%, not greater than 25%, not greater than 20%, not greater than 15%, not greater than 10%, or even not greater than 5%. Still, in one non-limiting embodiment, the second content (C2) may be present in an amount of at least about 1% of the total content of the blend. For example, the second content may be at least 5%, such as at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or even at least 95%. It will be appreciated that the second content (C2) can be within a range between any of the minimum and maximum percentages noted above.

In accordance with another embodiment, the blend of abrasive particles may have a blend ratio (C1/C2) that may define a ratio between the first content (C1) and the second content (C2). For example, in one embodiment, the blend ratio (C1/C2) may be not greater than 10. In yet another embodiment, the blend ratio (C1/C2) may be not greater than 8, such as not greater than 6, not greater than 5, not greater than 4, not greater than 3, not greater than 2, not greater than 1.8, not greater than 1.5, not greater than 1.2, not greater than 1, not greater than 0.9, not greater than 0.8, not greater than 0.7, not greater than 0.6, not greater than 0.5, not greater than 0.4, not greater than 0.3, or even not greater than 0.2. Still, in another non-limiting embodiment, the blend ratio (C1/C2) may be at least 0.1, such as at least 0.15, at least 0.2, at least 0.22, at least 0.25, at least 0.28, at least 0.3, at least 0.32, at least 0.3, at least 0.4, at least 0.45, at least 0.5, at least 0.55, at least 0.6, at least 0.65, at least 0.7, at least 0.75, at least 0.8, at least 0.9, at least 0.95, at least 1, at least 1.5, at least 2, at least 3, at least 4, or even at least 5. It will be appreciated that the blend ratio (C1/C2) may be within a range between any of the minimum and maximum values noted above.

In other non-limiting embodiments, the blend may include other types of abrasive particles. For example, the blend may include a third type of abrasive particle that may include a conventional abrasive particle or a shaped abrasive particle. The third type of abrasive particle may include a diluent type of abrasive particle having an irregular shape, which may be achieved through conventional crushing and comminution techniques.

The abrasive particles may have a particular average particle size. For example, the abrasive particles may have an average particle size of not greater than 3 mm, such as not greater than 2 mm or not greater than 1 mm or not greater than 900 microns or not greater than 800 microns or not greater than 700 microns or even not greater than 600 microns. According to one non-limiting embodiment, the average particle size of the abrasive particles can be at least 100 microns, such as at least 200 microns or at least 300 microns or at least 400 microns or at least 500 microns or at least 600 microns or at least 700 microns or at least 800 microns or at least 900 microns or at least 1 mm or at least 1.2 mm or at least 1.5 mm or at least 2 mm. It will be appreciated that the average particle size of the abrasive particles can be within a range including any of the minimum and maximum values noted above.

As described herein, in addition to the abrasive particles, the mixture may also include other components or precursors to facilitate formation of the abrasive article. For example, the mixture may include a bond material or a precursor of the bond material. According to another embodiment, the mixture may include an organic material, or a precursor of an organic material, suitable for formation of an organic bond material during further processing. Such an organic material may include one or more natural organic materials, synthetic organic materials, and a combination thereof. In particular instances, the organic material can be made of a resin, which may include a thermoset, a thermoplastic, and a combination thereof. For example, some suitable resins can include phenolics, epoxies, polyesters, cyanate esters, shellacs, polyurethanes, polybenzoxazines, polybismaleimides, polyimides, rubber, and a combination thereof. In one particular embodiment, the mixture includes an uncured resin material configured to form a phenolic resin bond material through further processing.

The phenolic resin may be modified with a curing or cross-linking agent, such as hexamethylene tetramine. At temperatures in excess of about 90° C., some examples of the hexamethylene tetramine may form crosslinks to form methylene and dimethylene amino bridges that help cure the resin. The hexamethylene tetramine may be uniformly dispersed within the resin. More particularly, hexamethylene tetramine may be uniformly dispersed within resin regions as a cross-linking agent. Even more particularly, the phenolic resin may contain resin regions with cross-linked domains having a sub-micron average size.

Other materials, such as a filler, can be included in the mixture. The filler may or may not be present in the finally-formed abrasive article. The filler may include a material selected from the group consisting of powders, granules, spheres, fibers, and a combination thereof. Moreover, in particular instances, the filler can include an inorganic material, an organic material, fibers, woven materials, non-woven materials, particles, minerals, nuts, shells, oxides, alumina, carbide, nitrides, borides, polymeric materials, naturally occurring materials, and a combination thereof. In a certain embodiment, the filler can include a material such as sand, bubble alumina, chromites, magnesite, dolomites, bubble mullite, borides, titanium dioxide, carbon products (e.g., carbon black, coke or graphite), silicon carbide, wood flour, clay, talc, hexagonal boron nitride, molybdenum disulfide, feldspar, nepheline syenite, glass spheres, glass fibers, $CaF_2$, $KBF_4$, Cryolite ($Na_3AlF_6$), potassium Cryolite ($K_3AlF_6$), pyrites, ZnS, copper sulfide, mineral oil, fluorides, carbonates, calcium carbonate, wollastonite, mullite, steel, iron, copper, brass, bronze, tin, aluminum, kyanite, alusite, garnet, quartz, fluoride, mica, nepheline syenite, sulfates (e.g., barium sulfate), carbonates (e.g., calcium carbonate), titanates (e.g., potassium titanate fibers), rock wool, clay, sepiolite, iron sulfide (e.g., $Fe_2S_3$, $FeS_2$, or a combination thereof), potassium fluoroborate ($KBF_4$), zinc borate, borax, boric acid, fine alundum powders, P15A, cork, glass spheres, silica microspheres (Z-light), silver, Saran™ resin, paradichlorobenzene, oxalic acid, alkali halides, organic halides, attapulgite or any combination thereof. In particular instances wherein the filler is particulate material, it may be distinct from the abrasive particles, being significantly smaller in average particle size than the abrasive particles. In another particular instance, the filler can include iron and sulfur having an average particle size of not greater than about 40 microns.

In at least one embodiment, further additives may be included in the mixture. For example, the mixture can include an antistatic agent, a lubricant, a porosity inducer, wetting agent, coloring agent, or any combination thereof to facilitate mixing and/or formation of the abrasive article.

After forming the mixture, the process can continue to block 102 to form the mixture into a green body comprising abrasive particles contained in a bond material. A green body is a body that is unfinished and may undergo further processing before a finally-formed abrasive article is formed. Forming of the green body can include techniques such as pressing, molding, casting, printing, spraying, and a combination thereof. In one particular embodiment, forming of the green body can include pressing the mixture into a particular shape, including for example, conducting a pressing operation to form a green body in the form of a grinding wheel.

It will also be appreciated that one or more reinforcing materials may be included within the mixture, or between portions of the mixture to create a composite body including one or more abrasive portions (i.e., abrasive particles contained within the bond material as well as porosity, fillers and the like) and reinforcing portions made up of the reinforcing materials. Some suitable examples of reinforcing materials include woven materials, non-woven materials, fiberglass, fibers, naturally occurring materials, synthetic materials, inorganic materials, organic materials, or any combination thereof. As used herein, terms such as "reinforced" or "reinforcement" refer to discrete layers or portions of a reinforcing material that is different from the bond and abrasive materials employed to make the abrasive portions. Terms such as "internal reinforcement" or "internally reinforced" indicate that these components are within or embedded in the body of the abrasive article. In cut-off wheels the internal reinforcement can be, for example, in the shape of a disc with a middle opening to accommodate the arbor hole of the wheel. In some wheels, the reinforcing materials extend from the arbor hole to the periphery of the body. In others, reinforcing materials can extend from the periphery of the body to a point just under the flanges used to secure the body. Some abrasive articles may be "zone reinforced" with (internal) fiber reinforcement around the arbor hole and flange areas of the body (about 50% of the diameter of the body).

After forming the mixture with the desired components and applying the mixture in the desired processing apparatus, the process can continue to block 103 illustrated in FIG. 1, by treating the mixture to form a finally-formed abrasive article. Some suitable examples of treating can include curing, heating, pressing, or a combination thereof. In one example, the process may include bond batching, mixing abrasive particles with bond or bond precursor materials, filling a mold, pressing, and heating or curing the mixture.

After finishing the treating process, the abrasive article can be formed including an abrasive body including abrasive particles and, optionally, any other additives contained within a bond matrix. In a particular embodiment, the abrasive body can be a bonded body. In an aspect, the bonded body can include abrasive particles and bond material extending in three dimensions through at least a portion of the volume of the bonded body. In another aspect, the bonded body can include abrasive particles contained in a three dimensional bond matrix. In another embodiment, the abrasive body can have a shape including wheels, hones, cones, cups, flanged-wheels, tapered cups, discs, segments, mounted points, or a combination thereof.

In an embodiment, the impact modifier particles can be uniformly dispersed in the bond material. In an embodiment, the abrasive body can include a particular content of the impact modifier that can facilitate improved property and performance of the abrasive article. In an aspect, the body can include at least 1 vol % of the impact modifier particles for a total volume of the body or at least 2 vol % or at least 3 vol % or at least 4 vol % for a total volume of the body. In another aspect, the body can include at most 10 vol % of impact modifier particles for a total volume of the body, at most 9 vol %, at most 8 vol %, at most 7 vol %, at most 6 vol %, at most 5 vol %, or at most 4 vol % of impact modifier particles for a total volume of the body. In a particular aspect, the impact modifier particles can be in a content including any of the minimum and maximum percentages noted herein. For example, the body can include impact modifier particles in a content in a range including at least 1 vol % and at most 10 vol % for the total volume of the body or in a range including at least 1 vol % and at most 5 vol % for the total volume of the body.

In a further embodiment, the abrasive body can include a particular content of the bond material. In an aspect, the body can include at most 98 vol % bond material for a total volume of the body or at most 95 vol % or at most 90 vol % or at most 85 vol % or at most 80 vol % or at most 75 vol % or at most 70 vol % or at most 65 vol % or at most 60 vol % or at most 55 vol % or at most 50 vol % or at most 45 vol % or at most 40 vol % or at most 35 vol % or at most 30 vol % or at most 25 vol % for a total volume of the body. In another aspect, the body comprises at least 1 vol % bond material for a total volume of the body or at least 2 vol % or at least 5 vol % or at least 10 vol % or at least 20 vol % or at least 30 vol % or at least 35 vol % or at least 40 vol % or at least 45 vol % for a total volume of the body. In a further aspect, the body can include a content of the bond material in a range including any of the minimum and maximum percentages noted herein.

In a further embodiment, the abrasive body can include a particular content of the abrasive particles. In an aspect, the body can include at least 1 vol % abrasive particles for a total volume of the body, or at least 2 vol % or at least about 4 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 35 vol % for a total volume of the body. In another aspect, the body can include at most 65 vol % abrasive particles for a total volume of the body or at most 64 vol % or at most 62 vol % or at most 60 vol % or at most 58 vol % or at most 56 vol % or at most 54 vol % or at most 52 vol % or at most 50 vol % or at most 48 vol % or at most 46 vol % or at most 44 vol % or at most 42 vol % or at most 40 vol % or at most 38 vol % or at most 36 vol % or at most 34 vol % or at most 32 vol % or at most 30 vol % or at most 28 vol % or at most 26 vol % or at most 24 vol % or at most 22 vol % or at most 20 vol % for a total volume of the body. In a further aspect, the body can include a content of the abrasive particles in a range including any of the minimum and maximum percentages noted herein.

In an embodiment, the body can include a particular content of porosity. In an aspect, the body can include a type of porosity selected from the group consisting of closed porosity, open porosity, and a combination thereof. In exemplary applications, the body can include porosity, wherein the majority of the porosity can be closed porosity. In particular applications, the porosity can consist essentially of closed porosity. In another example, the majority of the porosity can be open porosity. In a particular example, the body can include porosity, wherein essentially all of the porosity can be open porosity.

In another aspect, the body can include a particular content of porosity. For example, the body can include at least 1 vol % porosity for a total volume of the body or at least 2 vol % or at least 4 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 40 vol % or at least 45 vol % or at least 50 vol % or at least 55 vol %. In another example, the body can include at most 80 vol % porosity for a total volume of the body or at most 75 vol % or at most 70 vol % or at most 65 vol % or at most 60 vol % or at most 55 vol % or at most 50 vol % or at most 45 vol % or at most 40 vol % or at most 35 vol % or at most 30 vol % or at most 25 vol % or at most 20 vol % or at most 15 vol % or at most 10 vol % or at most 5 vol % or at most 2 vol %. In a further example, the body can include a content of porosity in a range including any of the minimum and maximum percentages noted herein.

It is notable the abrasive article can have improved properties and/or performance. In an aspect, the abrasive article can have improved EMOD and improved ratio of MOR to EMOD. For example, the abrasive article can include a ratio of MOR to EMOD of greater than 5.7, such as at least 5.9, at least 6.2, at least 6.4, or at least 6.5. In another example, the abrasive article can include a ratio of MOR to EMOD of at most 8.0, at most 7.7, at most 7.5, at most 7.3, at most 7.0, at most 6.8, or at most 6.5. In certain instances, such as when the body includes relatively lower content of abrasive particles, the ratio of MOR to EMOD may be higher than 8.0, such as at least 8.5, at least 9.0, or even higher than 9.0. In further instance, the ratio of MOR to EMOD may be at most 12 or at most 10. Moreover, the ratio of MOR to EMOD can be in a range including any of the minimum and maximum values noted herein.

In a particular embodiment, the abrasive article can include a MOR to EMOD ratio of greater than 5.7 when the bonded body includes abrasive particles of at least 36 vol % for a total volume of the body. In an aspect, the abrasive article can include a MOR to EMOD ratio of greater than 5.7 and at most 7.8 when the body includes abrasive particles in a content from 48 vol % to 52 vol % for the total volume of the body. In a further aspect, the abrasive article can include a MOR to EMOD ratio of greater than 7.8 and at most 9 when the body includes abrasive particles in a content from 42 vol % to less than 48 vol % for the total volume of the body. In another aspect, the abrasive article can include a MOR to EMOD ratio of greater than 9 and at most 12 when the body includes abrasive particles in a content from 36 vol % to less than 42 vol % for the total volume of the body.

In a further embodiment, the body can include impact modifier particles having any of the particles sizes described in embodiments herein, such as $D_{10}$, $D_{50}$, $D_{90}$, or any combination thereof. The particle size of the impact modifier in the body of the abrasive article can be determined using Confocal Raman Microscope Spectrometer with Renishaw Centrus 0RNQ39. The distribution of particles of the impact modifier can be mapped and the particle sizes can be measured using 785 nm long-pass edge filter, 1200 I/mm (633/780) grating, and 50× objective lens on a cross section of a finally formed body (e.g., bonded abrasive body). Raman mapping can be performed in an area between 1700 and 1654 $cm^{-1}$ for impact modifier particles and 747 and 803 $cm^{-1}$ for the bond material. A statistical significant number (e.g., at least 50) of impact modifier particles can be measured to obtain particle sizes such as $D_{10}$, $D_{50}$, and $D_{90}$. The following Raman spectrometer parameter can be used.

In a particular embodiment, the abrasive article can be particularly suited for high precision material removal operations. For example, the abrasive article can include a grinding wheel, and particularly, a high precision grinding wheel. The abrasive article can have improved grinding surface quality, such as reduced roughness, reduced number of scratches, spirals, or chatters, or any combination thereof.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1. An abrasive article comprising:
a body including:
a bond material;
abrasive particles contained within the bond material; and
an impact modifier including a plurality of particles contained in the bond material, wherein the plurality of particles comprises:
an average particle size ($D_{50}$) of at least 10 microns;
a particle size $D_{10}$ of at least 2 microns;
a particles size $D_{90}$ of at most 1 mm; or
any combination thereof.

Embodiment 2. An abrasive article, comprising:
a bonded body including:
a bond material;
abrasive particles contained within the bond material; and
an impact modifier contained in the bond material, wherein the impact modifier is in a content of at least 1 vol % of and at most 10 vol % for a total volume of the body.

Embodiment 3. An abrasive article, comprising:
a bonded body including:
a bond material;
abrasive particles contained within the bond material;
an impact modifier contained in the bond material; and
a ratio of MOR to EMOD of greater than 5.7.

Embodiment 4. The abrasive article of any one of embodiments 1 to 3, wherein the impact modifier comprises a plurality of particles having an average particle size of at least 10 microns, at least 40 microns, at least 60 microns, at least 90 microns, at least 100 microns, at least 120 microns, at least 140 microns, at least 160 microns, at least 180 microns, or at least 200 microns.

Embodiment 5. The abrasive article of any one of embodiments 1 to 3, wherein the impact modifier comprises a plurality of particles having an average particle size of at most 900 microns, at most 800 microns, at most 700 microns, at most 600 microns, at most 500 microns, at most 450 microns, at most 400 microns, at most 350 microns, or at most 300 microns.

Embodiment 6. The abrasive article of any one of embodiments 1 to 3, wherein the impact modifier is in a content of at least 1 vol % for a total volume of the body or at least 2 vol % or at least 3 vol % or at least 4 vol % for a total volume of the body.

Embodiment 7. The abrasive article of any one of embodiments 1 to 3, wherein the impact modifier is in a content of at most 10 vol % for a total volume of the body, at most 9 vol %, at most 8 vol %, at most 7 vol %, at most 6 vol %, at most 5 vol %, or at most 4 vol % for a total volume of the body.

Embodiment 8. The abrasive article of any one of embodiments 1 to 3, wherein the impact modifier comprises a plurality of particles, wherein the impact modifier is in a content of at least 1 vol % and at most 5 vol % for a total volume of the body.

Embodiment 9. The abrasive article of any one of embodiments 1 to 3, wherein the impact modifier comprises a plurality of particles comprising a particle size $D_{10}$ of at least 2 microns, at least 4 microns, at least 5 microns, at least 8 microns, at least 10 microns, at least 15 microns, at least 20 microns, at least 25 microns, at least 30 microns, at least 35 microns, at least 40 microns, at least 45 microns, at least 50 microns, at least 55 microns, at least 60 microns, at least 65 microns, at least 70 microns, at least 75 microns, at least 80 microns, at least 85 microns, at least 90 microns, at least 95 microns, or at least 100 microns.

Embodiment 10. The abrasive article of any one of embodiments 1 to 3, wherein the impact modifier comprises a plurality of particles comprising a particle size $D_{90}$ of at most 1000 microns, at most 950 microns, at most 900 microns, at most 850 microns, at most 800 microns, at most 750 microns, at most 720 microns at most 700 microns, at most 680 microns, at most 650 microns, at most 620 microns, at most 600 microns, at most 550 microns, at most 520 microns, at most 500 microns, at most 480 microns, at most 460 microns, at most 450 microns, at most 430 microns, at most 410 microns, or at most 400 microns.

Embodiment 11. The abrasive article of any one of embodiments 1 to 3, wherein the impact modifier comprises agglomerated particles, unagglomerated particles, or a combination thereof.

Embodiment 12. The abrasive article of any one of embodiments 1 to 3, wherein the impact modifier comprises a plurality of particles having a core-shell structure.

Embodiment 13. The abrasive article of any one of embodiments 1 to 3, wherein the impact modifier comprises a plurality of unagglomerated particles having a core-shell structure.

Embodiment 14. The abrasive article of any one of embodiments 1 to 3, wherein the impact modifier comprises a plurality of agglomerated particles having a core-shell structure.

Embodiment 15. The abrasive article of embodiment 14, wherein particles contained in the agglomerated particles comprise an average particle size of at least 1 nm, at least 2 nm, at least 5 nm, at least 10 nm, at least 15 nm, at least 20 nm, at least 25 nm, at least 30 nm, at least 35 nm, at least 40 nm, at least 50 nm, at least 60 nm, at least 70 nm, at least 80 nm, at least 90 nm, at least 100 nm, at least 200 nm, at least 300 nm, at least 400 nm, at least 500 nm, at least 600 nm, at least 700 nm, at least 800 nm, at least 900 nm, at least 1 micron, at least 2 microns, at least 5 microns, at least 10 microns, or at least 20 microns.

Embodiment 16. The abrasive article of embodiment 14, wherein particles contained in the agglomerated particles comprise an average particle size of at most 100 microns, at most 90 microns, at most 80 microns, at most 70 microns, at most 60 microns, at most 50 microns, at most 40 microns, at most 30 microns, at most 20 microns, at most 10 microns, at most 9 microns, at most 8 microns, at most 7 microns, at most 6 microns, at most 4 microns, at most 3 microns, at most 1 micron, at most 800 nm, at most 700 nm, at most 600 nm, at most 500 nm, at most 400 nm, at most 300 nm, at most 200 nm, or at most 100 nm.

Embodiment 17. The abrasive article of embodiment 14, wherein at least 50 vol % of the particles contained in the agglomerated particles have a size in a range from 1 nm to 2 microns, at least 60 vol %, at least 70 vol %, at least 80 vol %, or at least 90 vol % of the particles contained in the agglomerated particles have the size in the range from 1 nm to 2 microns.

Embodiment 18. The abrasive article of embodiment 12, wherein the core, the shell, or both includes an organic material.

Embodiment 19. The abrasive article of embodiment 12, wherein the core comprises a modulus that is different from a modulus the shell.

Embodiment 20. The abrasive article of embodiment 12, wherein the core comprises a polymer comprising rubber type polymers including butadiene rubber, butadiene styrene rubber, butadiene-acrylonitrile rubber, or any combination thereof.

Embodiment 21. The abrasive article of embodiment 12, wherein the shell comprises a polymer comprising acrylic polymer, styrene polymer, or any combination thereof.

Embodiment 22. The abrasive article of any one of embodiments 1 to 3, wherein the plurality of impact modifiers comprise a polymer including methyl methacrylate-butadiene-styrene polymer, acrylic-butadiene-styrene polymer, or a combination thereof.

Embodiment 23. The abrasive article of any one of embodiments 1 to 3, wherein the body further comprises a ratio of MOR to EMOD of greater than 5.7, at least 5.9, at least 6.2, at least 6.4, or at least 6.5.

Embodiment 24. The abrasive article of any one of embodiments 1 to 3, wherein the body further comprises a ratio of MOR to EMOD of at most 8.0, at most 7.7, at most 7.5, at most 7.3, at most 7.0, at most 6.8, or at most 6.5.

Embodiment 25. The abrasive article of any one of embodiments 1 to 3, wherein the body comprises a fixed abrasive article.

Embodiment 26. The abrasive article of any one of embodiments 1 to 3, wherein the body comprises at least 1 vol % abrasive particles for a total volume of the body, or at least 2 vol % or at least about 4 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 35 vol % for a total volume of the body.

Embodiment 27. The abrasive article of embodiment 26, wherein the body comprises at most 65 vol % abrasive particles for a total volume of the body or at most 64 vol % or at most 62 vol % or at most 60 vol % or at most 58 vol % or at most 56 vol % or at most 54 vol % or at most 52 vol % or at most 50 vol % or at most 48 vol % or at most 46 vol % or at most 44 vol % or at most 42 vol % or at most 40 vol % or at most 38 vol % or at most 36 vol % or at most 34 vol % or at most 32 vol % or at most 30 vol % or at most 28 vol % or at most 26 vol % or at most 24 vol % or at most 22 vol % or at most 20 vol % for a total volume of the body.

Embodiment 28. The abrasive article of any one of embodiments 1 to 3, wherein the abrasive particles comprise abrasive particles selected from the group consisting of oxides, carbides, nitrides, borides, oxycarbides, oxynitrides, superabrasives, carbon-based materials, agglomerates, aggregates, shaped abrasive particles, microcrystalline materials, nanocrystalline materials, and a combination thereof.

Embodiment 29. The abrasive article of any one of embodiments 1 to 3, wherein the abrasive particles comprise shaped abrasive particles comprising a two dimensional shape selected from the group consisting of regular polygons, irregular polygons, irregular shapes, triangles, partially-concave triangles, quadrilaterals, rectangles, trapezoids, pentagons, hexagons, heptagons, octagons, ellipses, Greek alphabet characters, Latin alphabet characters, Russian alphabet characters, a triangular two-dimensional shape, a partially-concave triangular two-dimensional shape, and a combination thereof.

Embodiment 30. The abrasive article of any one of embodiments 1 to 3, wherein the abrasive particles comprise shaped abrasive particles comprising a three-dimensional shape selected from the group consisting of a polyhedron, a pyramid, an ellipsoid, a sphere, a prism, a cylinder, a cone, a tetrahedron, a cube, a cuboid, a rhombohedron, a truncated pyramid, a truncated ellipsoid, a truncated sphere, a truncated cone, a pentahedron, a hexahedron, a heptahedron, an octahedron, a nonahedron, a decahedron, a Greek alphabet letter, a Latin alphabet character, a Russian alphabet character, a Kanji character, complex polygonal shapes, irregular shaped contours, a volcano shape, a monostatic shape, and a combination thereof.

Embodiment 31. The abrasive article of any one of embodiments 1 to 3, wherein the abrasive particles comprise shaped abrasive particles including a body having a body length (Lb), a body width (Wb), and a body thickness (Tb), and wherein Lb>Wb, Lb>Tb, and Wb>Tb.

Embodiment 32. The abrasive article of embodiment 30, wherein the body comprises a primary aspect ratio (Lb:Wb) of at least about 1:1 or at least about 2:1 or at least about 3:1 or at least about 5:1 or at least about 10:1, and at most about 1000:1.

Embodiment 33. The abrasive article of embodiment 32, wherein the body comprises a secondary aspect ratio (Lb:Tb) of at least about 1:1 or at least about 2:1 or at least about 3:1 or at least about 5:1 or at least about 10:1, and at most about 1000:1.

Embodiment 34. The abrasive article of embodiment 33, wherein the body comprises a tertiary aspect ratio (Wb:Tb) of at least about 1:1 or at least about 2:1 or at least about 3:1 or at least about 5:1 or at least about 10:1, and at most about 1000:1.

Embodiment 35. The abrasive article of embodiment 31, wherein at least one of the body length (Lb), the body width (Wb), and the body thickness (Tb) has an average dimension of at least about 0.1 microns or at least about 1 micron or at least about 10 microns or at least about 50 microns or at least about 100 microns or at least about 150 microns or at least about 200 microns or at least about 400 microns or at least about 600 microns or at least about 800 microns or at least about 1 mm, and at most about 20 mm or at most about 18 mm or at most about 16 mm or at most about 14 mm or at most about 12 mm or at most about 10 mm or at most about 8 mm or at most about 6 mm or at most about 4 mm.

Embodiment 36. The abrasive article of any one of embodiments 1 to 3, wherein the body comprises at most 98 vol % bond material for a total volume of the body or at most 95 vol % or at most 90 vol % or at most 85 vol % or at most 80 vol % or at most 75 vol % or at most 70 vol % or at most 65 vol % or at most 60 vol % or at most 55 vol % or at most 50 vol % or at most 45 vol % or at most 40 vol % or at most 35 vol % or at most 30 vol % or at most 25 vol % for a total volume of the body.

Embodiment 37. The abrasive article of any one of embodiments 1 to 3, wherein the body comprises at least 1 vol % bond material for a total volume of the body or at least 2 vol % or at least 5 vol % or at least 10 vol % or at least 20 vol % or at least 30 vol % or at least 35 vol % or at least 40 vol % or at least 45 vol % for a total volume of the body.

Embodiment 38. The abrasive article of any one of embodiments 1 to 3, wherein the bond material comprises one or more natural organic materials, synthetic organic materials, or a combination thereof.

Embodiment 39. The abrasive article of any one of embodiments 1 to 3, wherein the bond material consists essentially of an organic material.

Embodiment 40. The abrasive article of any one of embodiments 1 to 3, wherein the bond material comprises a material comprising phenolic resins, a phenolic resin having cross-linked domains having a sub-micron average size, a phenolic resin modified with a curing or cross-linking agent including hexamethylene tetramine, epoxies, polyesters, cyanate esters, shellacs, polyurethanes, rubber, and a combination thereof.

Embodiment 41. The abrasive article of any one of embodiments 1 to 3, wherein the body comprises at least 1 vol % porosity for a total volume of the body or at least 2 vol % or at least 4 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 40 vol % or at least 45 vol % or at least 50 vol % or at least 55 vol %.

Embodiment 42. The abrasive article of any one of embodiments 1 to 3, wherein the body comprises at most 80 vol % porosity for a total volume of the body or at most 75 vol % or at most 70 vol % or at most 65 vol % or at most 60 vol % or at most 55 vol % or at most 50 vol % or at most 45 vol % or at most 40 vol % or at most 35 vol % or at most 30 vol % or at most 25 vol % or at most 20 vol % or at most 15 vol % or at most 10 vol % or at most 5 vol % or at most 2 vol %.

Embodiment 43. The abrasive article of any one of embodiments 1 to 3, wherein the body comprises porosity comprising a type of porosity selected from the group consisting of closed porosity, open porosity, and a combination thereof.

Embodiment 44. The abrasive article of any one of embodiments 1 to 3, wherein the body comprises porosity, and wherein a majority of the porosity is closed porosity, wherein the porosity consists essentially of closed porosity.

Embodiment 45. The abrasive article of any one of embodiments 1 to 3, wherein the body comprises porosity and the majority of the porosity is open porosity, wherein essentially all of the porosity is open porosity.

Embodiment 46. The abrasive article of any one of embodiments 1 to 3, wherein the body comprises a filler selected from the group consisting of powders, granules, spheres, fibers, chopped strand fibers (CSF), hollow particles, polymer hollow spheres, or a combination thereof.

Embodiment 47. The abrasive article of any one of embodiments 1 to 3, wherein the body comprises a filler comprising a material selected from the group consisting of sand, bubble alumina, chromites, magnetite, dolomites, bubble mullite, borides, titanium dioxide, carbon products, silicon carbide, wood flour, clay, talc, hexagonal boron nitride, molybdenum disulfide, feldspar, nepheline syenite, glass spheres, glass fibers, basalt fibers, $CaF_2$, $KBF_4$, Cryolite ($Na_3AlF_6$), potassium Cryolite ($K_3AlF_6$), pyrite, ZnS, copper sulfide, mineral oil, fluorides, carbonates, calcium carbonate, saran, phenoxy resin, CaO, $K_2SO_4$, mineral wool, $MnCl_2$, KCl, dolomite, or a combination thereof.

Embodiment 48. The abrasive article of any one of embodiments 1 to 47, wherein the body comprises a filler including a material comprising an antistatic agent, a lubricant, a porosity inducer, coloring agent, and a combination thereof.

Embodiment 49. The abrasive article of any one of embodiments 1 to 3, wherein the body comprises a filler comprising iron and sulfur having an average particle size of at most about 40 microns.

Embodiment 50. The abrasive article of any one of embodiments 1 to 3, wherein the body has a shape selected from the group consisting of wheels, hones, cones, cups, flanged-wheels, tapered cups, discs, segments, mounted points, and a combination thereof.

EXAMPLES

Example 1

Grinding wheel samples S1 are formed according to embodiments herein. The components included in Table 1 are mixed and the mixture is formed into bodies of grinding wheels. The wheel bodies have the dimension of 750×60×304.8 mm. Even though ranges are provided, it is to be understood that the contents of all the components add up to 100 wt %. The impact modifier has a core-shell structure including a core including butadiene rubber and a shell including methyl methacrylate-styrene polymer.

TABLE 1

| Components | Contents (wt %) |
|---|---|
| Silicon carbide abrasive particles (150#) | 82 to 92% |
| Powder phenolic resin | 6 to 15% |
| Liquid phenolic resin | 1.2 to 2.4% |
| Wetting agent | 0.3 to 0.6% |
| MBS Impact modifier | 0.1 to 0.3% |

Grinding wheel Samples C2 are formed having similar components to S1 except the C2 samples are formed without impact modifier. All the samples are tested for grinding M2 high-speed steel rolls on cylindrical grinding machine (an OD grinding machine) under the same conditions. Table 2 includes surface evaluation results of the workpieces after removal of 0.03 mm.

TABLE 2

| | C2 | S1 |
|---|---|---|
| Roughness Ra (0.18 to 0.24 microns) | OK (fall within the numerical range) | OK (fall within the numerical range) |
| Chatter (tested by roundness meter) | OK (no chatter) | OK (no chatter) |
| Spiral (tested by roundness meter) | OK (no spiral) | OK (no spiral) |
| Scratch (determined by examining images taken by a camera) | Not OK (See FIG. 3) | OK (See FIG. 3) |
| Visual pattern (observation by naked eyes) | Not OK (less uniform) | OK (uniform) |

Figure 2:
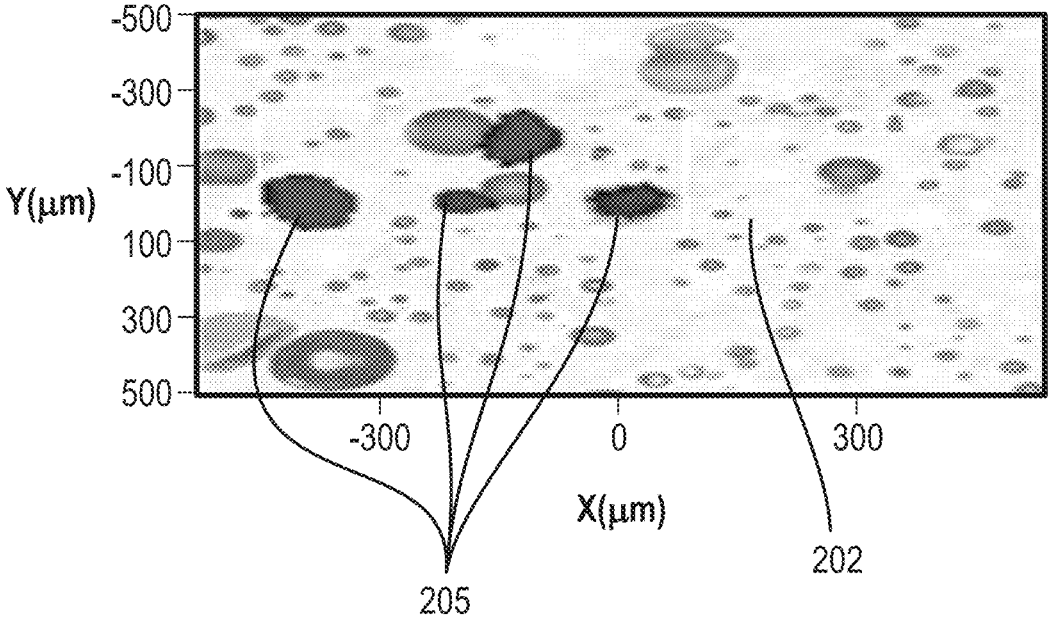
FIG. 2 includes a confocal Raman microscope image of a cross section of an exemplary body according to embodiments.

Referring to FIG. 2, a Raman microscope image of a cross section of an S1 sample is included. Impact modifier particles 205 are dispersed in the bond material 202. The size distribution, including $D_{50}$, $D_{10}$, $D_{90}$, can be determined by measuring at least 100 impact modifier particles. The impact modifiers particles include $D_{50}$ of 203.4 microns, D10 of 100.98 microns, and D90 of 385.4 microns.

Figure 3:
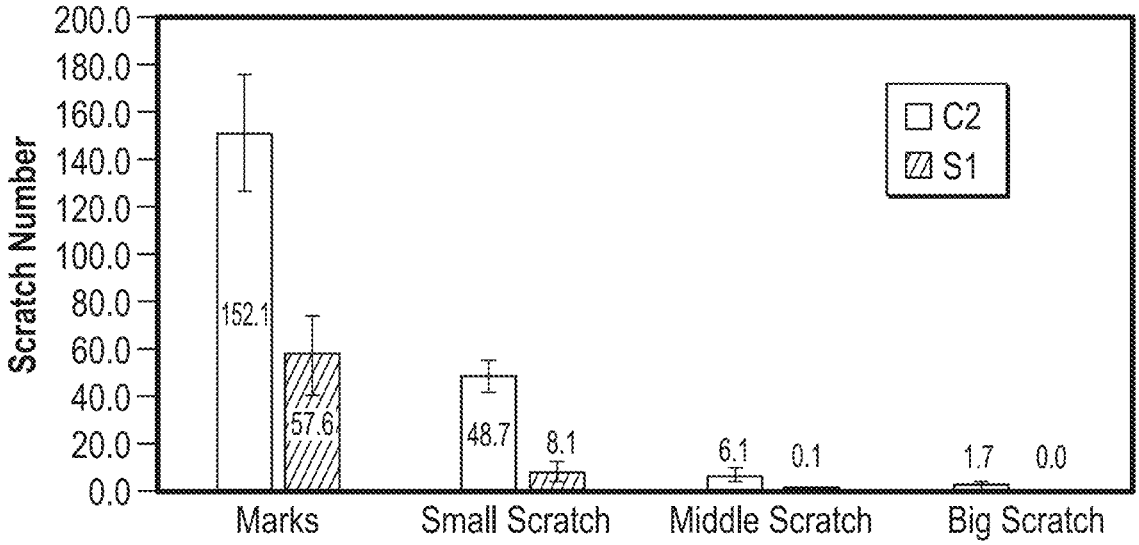
FIG. 3 includes a graph illustrating surface finishing results of work pieces ground by different abrasive samples.

FIG. 3 includes a graph including the number of scratches on the workpieces ground by S1 vs. C2. M2 roll ground by C2 has significantly greater number of scratches of the large, middle, and small sizes. As included in FIG. 3, big scratches have the length of greater than 400 microns to 600 microns, middle scratches have the length of greater than 240 microns to 400 microns, and small scratches have the length of 60 to 240 microns.

Example 2

Further grinding wheel samples are formed according to embodiments herein. The components included in Table 3 are mixed and the mixture is formed into bodies of grinding wheels. Even though ranges are provided for each component, it is to be understood the contents of all the components add up to 100 wt %. The same MBS impact modifier as Example 1 is used.

TABLE 3

| Components | Contents (wt %) |
|---|---|
| Alumina abrasive particles 60# | 82 to 92% |
| Powder phenolic resin | 6 to 15% |
| Liquid phenolic resin | 1.2 to 2.4% |
| Wetting agent | 0.3 to 0.6% |
| MBS Impact modifier | 0.1 to 0.3% |

Example 3

Grinding wheel samples S3 are formed using the mixture having the components included in Table 4 according to embodiments herein. The impact modifier has the same particle size distribution as described in Example 1. The samples are expected to have improved surface quality, wear life, grinding efficiency, or any combination thereof in a grinding test compared to a similar conventional sample that does not include the impact modifier.

TABLE 4

| Components | Typical Values (wt %) |
|---|---|
| Silicon carbide abrasive particles (150#) | 89.59% |
| Powder phenolic resin | 8.47% |
| Liquid phenolic resin | 1.44% |
| Wetting agent | 0.33% |
| Impact modifier | 0.16% |

Grinding wheel samples S4 are formed using the mixture having the components included in Table 5 according to embodiments herein. The impact modifier has the same particle size distribution as described in Example 1. The samples are expected to have improved surface quality, wear life, grinding efficiency, or any combination thereof in a grinding test compared to a conventional sample that does not include the impact modifier.

TABLE 5

| Components | Typical Values (wt %) |
|---|---|
| Alumina abrasive particles 60# | 84.39% |
| Powder phenolic resin | 12.76% |
| Liquid phenolic resin | 2.11% |
| Wetting agent | 0.52% |
| Impact modifier | 0.23% |

Example 4

Effect of MBS impact modifier in grinding wheels are tested. Grinding wheels under the commercial designation, 38A80-FB (available from Saint-Gobain Abrasives) of Grade G and Grades D to F were tested for MOR and EMOD. MBS impact modifiers having agglomerated particles are added to the initial mixture of the composition of G grade 38A80-FB wheels, as noted in Table 6, to form representative wheel samples including 1 wt %, 2 wt %, and 3 wt % impact modifier. The agglomerates have $D_{50}$ of 203.4 microns, D10 of 100.98 microns, and D90 of 385.4 microns. Each group includes 12 wheel samples. The wheel samples include the same bond material including rubber-modified phenolic resins.

Wheel Samples 1 to 5 are prepared as follows. The abrasive grains are first mixed with liquid phenolic resin in a mixing bowl for 2 to 7 minutes or until all of the grains are wet and coated by the liquid phenolic resin. The wet abrasive grains are then combined with the rest of the bond material. Impact modifiers are added for Samples 2 to 4. The mixture of each sample is poured into a mold and cold pressed. The samples are then removed from the mold and heat treated in a furnace at 160° C. to form bonded abrasive bodies.

TABLE 6

| Components | Contents (wt %) |
|---|---|
| Alumina abrasive particles 80# | 86.7% |
| Powder phenolic resin | 10.6% |
| Liquid phenolic resin | 1.9% |
| Wetting agent | 0.2% |
| Impact modifier | 1% to 3% |

Using conventional G grade 38A80-FB wheels as reference (groups 1 and 5), as noted in Table 7, from F Grade to E Grade (groups 6 to 8), MOR and EMOR of the wheel samples reduces. Relative MOR and relative EMOD is obtained by comparing the average MOR and EMOD of each Group to that of the respective Reference Group (Group 1 for Groups 2 to 4; and Group 5 for groups 6 to 8), respectively.

Comparing group 2 to group 6, wheels of group 2 has comparable MOR and EMOD. Comparing group 3 to group 7, wheels of group 3 have higher MOR and similar EMOD. Further comparing groups 4 and 8, group 4 has higher MOR over group 8 and comparable EMOD.

TABLE 7

| Group | Specification | Relative MOR | Relative EMOD | MOR | EMOD | Ratio of MOR to EMOD |
|---|---|---|---|---|---|---|
| 1 | 38A80-FB G grade, Reference | 100% | 100% | 35.0 | 5.8 | 6.0 |
| 2 | 38A80-FB G grade, + 1% MBS | 93% | 96% | 32.5 | 5.6 | 5.8 |
| 3 | 38A80-FB G grade, + 2% MBS | 88% | 82% | 30.8 | 4.8 | 6.4 |
| 4 | 38A80-FB G grade, + 3% MBS | 81% | 76% | 28.5 | 4.4 | 6.5 |
| 5 | 38A80-FB G grade, Reference | 100% | 100% | 35.0 | 5.8 | 6.0 |
| 6 | 38A80-FB F grade | 95% | 94% | 33.3 | 5.5 | 6.1 |
| 7 | 38A80-FB E grade | 72% | 83% | 25.2 | 4.8 | 5.3 |
| 8 | 38A80-FB D grade | 64% | 75% | 22.4 | 4.4 | 5.1 |

Example 5

Additional abrasive samples are formed with impact modifiers having agglomerated particles in which each particle has a core-shell structure. The particle size distribution of the agglomerates and materials of the core and shell of the impact modifiers are included in Table 8 below.

TABLE 8

| Impact Modifier | $D_{10}$ (μm) | $D_{50}$ (μm) | $D_{90}$ (μm) | Core | Shell |
|---|---|---|---|---|---|
| P1 | 58.07 | 222.95 | 577.17 | Butadiene rubber | methyl methacrylate polymer |
| P2 | 58.07 | 222.95 | 577.17 | Butadiene rubber | methyl methacrylatestyrene-styrene polymer |
| P3 | 177.73 | 424.24 | 844.66 | Butadiene rubber | methyl methacrylate polymer |
| P4 | 177.73 | 424.24 | 844.66 | Butadiene rubber | methyl methacrylate-styrene polymer |
| P5 | 80.58 | 239.04 | 652.15 | Butadiene rubber | methyl methacrylate styrene polymer |
| P6 | 80.58 | 239.04 | 652.15 | Butadiene rubber | methyl methacrylate polymer |
| P7 | 51.03 | 125.02 | 323.72 | Butadiene rubber | methyl methacrylate polymer |
| P8 | 94.65 | 195.95 | 362.17 | Butadiene rubber | methyl methacrylate-styrene polymer |
| P9 | 92.12 | 189.77 | 356.73 | Butadiene rubber | methyl methacrylate-styrene polymer |
| P10 | 87.04 | 344.42 | 897.67 | Butadiene rubber | methyl methacrylate-styrene polymer |
| P11 | 72.96 | 272.34 | 666.44 | Butadiene rubber | methyl methacrylate-styrene polymer |

Wheel samples are formed using the compositions noted in Tables 1 and 3, except that the MBS impact modifier is replaced with the above. The wheels are tested on M2 high-speed steel rolls and expected to have improved surface finishing compared to those without impact modifier. The wheels are expected to have improved EMOD, improved ratio of MOR to EMOD, or both.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Reference herein to a material including one or more components may be interpreted to include at least one embodiment wherein the material consists essentially of the one or more components identified. The term "consisting essentially" will be interpreted to include a composition including those materials identified and excluding all other materials except in minority contents (e.g., impurity contents), which do not significantly alter the properties of the material. Additionally, or in the alternative, in certain non-limiting embodiments, any of the compositions identified herein may be essentially free of materials that are not expressly disclosed. The embodiments herein include range of contents for certain components within a material, and it will be appreciated that the contents of the components within a given material total 100%.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive article comprising:

a body including:

a bond material;

abrasive particles contained within the bond material; and an impact modifier including a plurality of particles having a core-shell structure contained in the bond material, wherein the plurality of particles comprises:

an average particle size ($D_{50}$) of at least 10 microns;

a particle size $D_{10}$ of at least 2 microns;

a particle size $D_{90}$ of at most 2 mm; or any combination thereof.

2. The abrasive article of claim 1, wherein the plurality of particles comprises the average particle size ($D_{50}$) of at least 10 microns and at most 900 microns.

3. The abrasive article of claim 1, wherein the plurality of particles comprises the average particle size ($D_{50}$) of at least at least 60 microns and at most 800 microns.

4. The abrasive article of claim 1, wherein the plurality of particles comprises the average particle size ($D_{50}$) of at least 100 microns and at most 700 microns.

5. The abrasive article of claim 1, wherein the plurality of particles comprises the particle size $D_{10}$ of at least 5 microns and at most 600 microns.

6. The abrasive article of claim 1, wherein the plurality of particles comprises the particle size $D_{90}$ of at least 100 microns and at most 1.5 mm.

7. The abrasive article of claim 1, wherein a core of the core-shell structure includes an organic material.

8. The abrasive article of claim 1, wherein a core of the core-shell structure comprises a modulus that is different from a modulus of a shell of the core-shell structure.

9. The abrasive article of claim 1, wherein a core of the core-shell structure comprises a polymer.

10. The abrasive article of claim 9, wherein the polymer comprises butadiene rubber, butadiene-styrene rubber, butadiene-acrylonitrile rubber, or any combination thereof.

11. The abrasive article of claim 1, wherein a shell of the core-shell structure comprises a polymer including acrylic polymer, styrene polymer, or any combination thereof.

12. The abrasive article of claim 1, wherein the impact modifier comprises a polymer including methyl methacrylate-butadiene-styrene polymer, acrylic-butadiene-styrene polymer, or a combination thereof.

13. The abrasive article of claim 1, wherein the body comprises a ratio of MOR to EMOD of greater than 5.7.

14. The abrasive article of claim 1, wherein the plurality of particles comprise:

an average particle size ($D_{50}$) of at least 50 microns;

a particle size $D_{10}$ of at least 2 microns; and a particles size $D_{90}$ of at most 2 mm.

15. The abrasive article of claim 1, wherein the impact modifier has a Yang's modulus less than a Yang's modulus of the bond material.

16. The abrasive article of claim 1, comprising the impact modifier in a content of at least 1 vol % of and at most 10 vol % for a total volume of the body.

17. The abrasive article of claim 16, wherein the impact modifier is in a content of at least 1 vol % and at most 5 vol % for a total volume of the body.

18. The abrasive article of claim 16, wherein the body comprises a ratio of MOR to EMOD of greater than 5.7.

19. The abrasive article of claim 16, wherein the average particle size ($D_{50}$) is at least 50 microns and at most 900 microns.

* * * * *